United States Patent [19]

Parsons

[11] 4,235,067

[45] Nov. 25, 1980

[54] SEMI-AUTOMATIC BAGGING MACHINE

[75] Inventor: Ian A. Parsons, Mooroopna, Australia

[73] Assignee: E. D. Parsons Engineering, Victoria, Australia

[21] Appl. No.: 972,990

[22] Filed: Dec. 26, 1978

[30] Foreign Application Priority Data

Jul. 21, 1978 [AU] Australia ..... PD5165

[51] Int. Cl.[3] ..... B65B 1/32

[52] U.S. Cl. ..... 53/502; 53/506; 53/253

[58] Field of Search ..... 53/502, 506, 570, 253; 141/83

[56] References Cited

U.S. PATENT DOCUMENTS

| | | | |
|---|---|---|---|
| 2,081,122 | 5/1937 | Stetson | 141/83 |
| 2,654,518 | 10/1953 | Kindseth | 141/83 |
| 3,416,620 | 12/1968 | McClusky | 53/502 X |
| 3,720,276 | 3/1973 | Banks | 53/502 X |
| 3,842,569 | 10/1974 | McClelland et al. | 53/502 X |

*Primary Examiner*—Travis S. McGehee

*Attorney, Agent, or Firm*—Learman & McCulloch

[57] ABSTRACT

A semi-automatic bag filling and weighing machine is disclosed including a rotatable indexing table supporting a bag at four spaced locations around the table, a conveyor device for supplying articles to be weighed and filled into the bags, a weighing and filling station to which the bags are moved by the indexing table, a weighing and sensing device for actuating power cylinders operating in conjunction with the filling station, the indexing table and other control devices to move the indexing table so as to replace a filled bag with an empty bag at the filling station. Quick release bag clamping devices are also provided.

7 Claims, 7 Drawing Figures

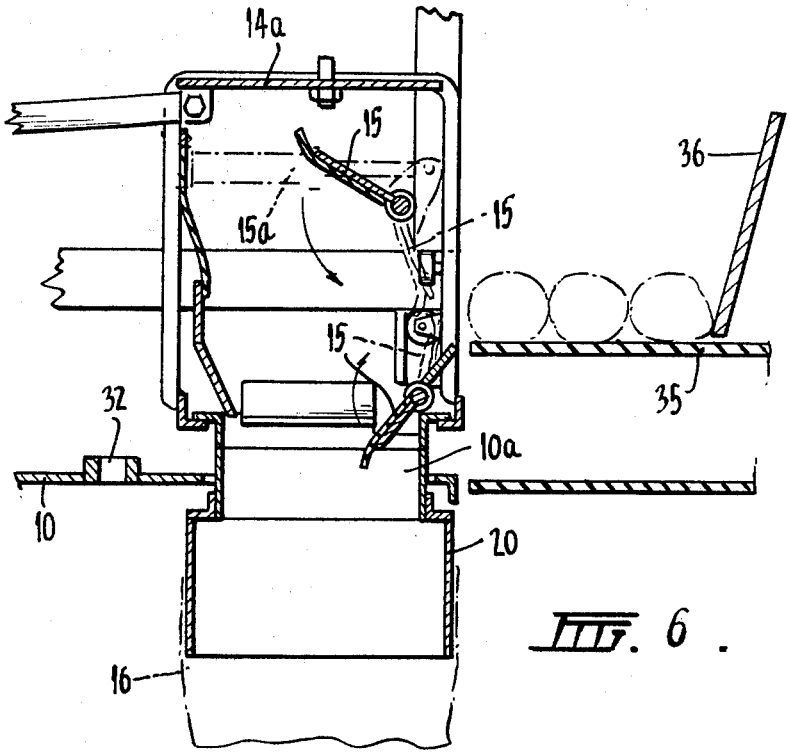
FIG. 6.
FIG. 7.
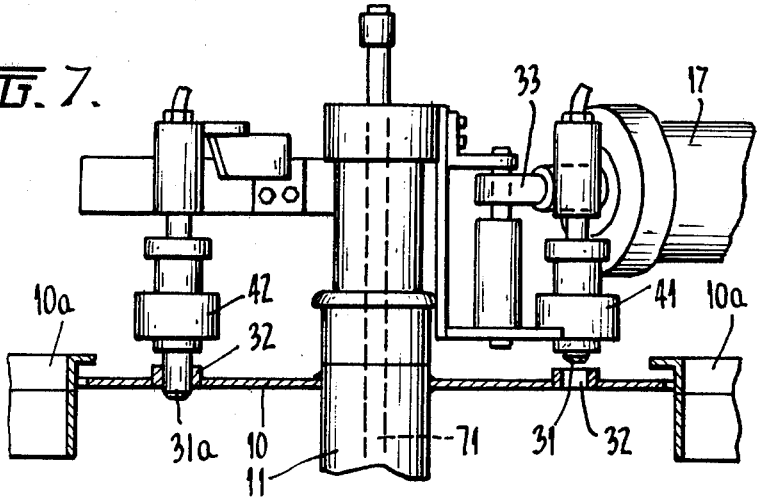

SEMI-AUTOMATIC BAGGING MACHINE

This invention relates to a semi-automatic bagging machine in which a bag is held and weighed whilst being filled with material which may be vegetables or the like such as potatoes, onions etc.

The task of manually filling bags to a correct weight is a menial task, prone to error and is slow.

It is the object of the present invention to mechanize the operation and obtain greater accuracy.

There is provided according to the present invention a bag filling and weighing machine including a rotatable indexing means supporting a bag to be filled with articles at a filling station, a weighing apparatus at the filling station taking the weight of a bag being filled, power means for rotating said indexing means, sensing means associated with said power means and said weighing apparatus for rotating said indexing means upon a bag being filled to a predetermined weight, the indexing means moving an empty bag into a filling position and said filled bag being moved to a position for removal from the indexing means.

Conveniently said filling station includes a conveyor from which articles are received. The filling station includes an angularly disposed blocking means mounted above the conveyor causing articles to be received from the conveyor in a narrow path in single file. Additional blocking flaps actuated in response to said sensing means are provided to stop flow of articles during an indexing operation.

The bags are gripped by a quick connect and release clamp holding the bag open for receipt of articles from the conveyor feed.

The invention will be described in more detail with reference to the accompanying drawings in which:

FIG. 6 is a part sectional view of the conveyor feed and taken on the line 6—6 of FIG. 4.

FIG. 7 is a partial, vertical sectional view of the indexing table control.

Figure 1:
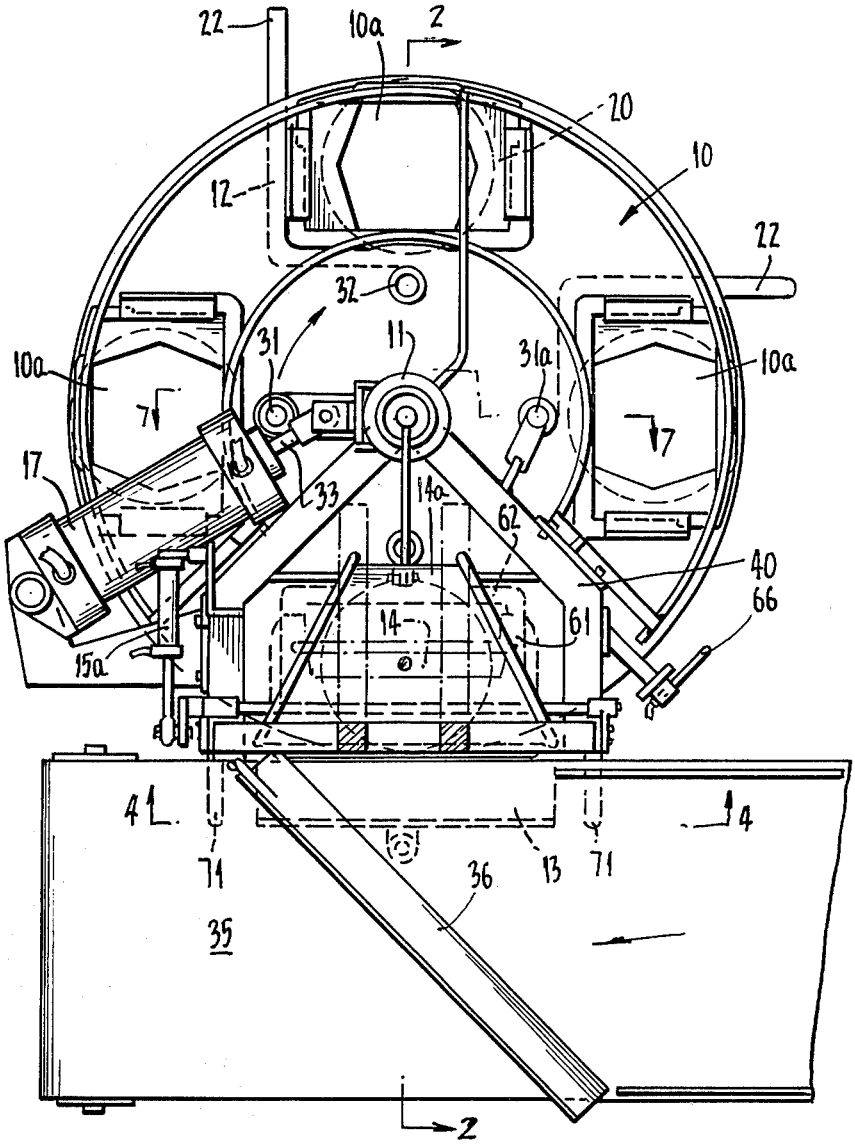
FIG. 1 is a plan view of the bagging and weighing machine associated with a conveyor feed.

Referring to FIG. 1, the machine includes a frame 40 and a rotatable indexing mechanism including a table 10 rotatably mounted on a central column 11. The table includes a number (optionally four) of feed holes 10*a* each associated with a bag clamp 12 best shown in FIGS. 4 and 5.

The machine is positioned adjacent a conveyor belt 35 of standard known construction. The conveyor device includes a deflector member 36 for deflecting articles on the conveyor towards the machine. Thus articles will be directed in single file into the feed openings of the machine; this will be described in more detail later.

Referring to FIGS. 1 and 7, the indexing mechanism will be described. The indexing table 10 includes a plate with apertures 32 into which an indexing pin 31 and a latch pin 31*a* are adapted to engage. The pins are operatively connected to small pneumatic power cylinders 41,42. The pins 31, 31*a* are adapted to be alternatively engaged with the apertures 32 so that pin 31*a* acts as a latching or locking pin to prevent accidental rotation of the table and the pin 31 is engageable with the aperture 32 when it is desired to rotate the indexing table. The pin 31 is operatively connected to indexing power cylinder 17 through piston rod 33 to move the indexing table a precise distance whilst the pin 31*a* is disengaged. The pin apertures 32 are equi-spaced around the table 10 and are equal in number to the number of feed holes 10*a*. Thus once an indexing movement has been completed the locking pin 31*a* can be operated by cylinder 42 to engage with the next spaced table aperture 32.

Figure 4:
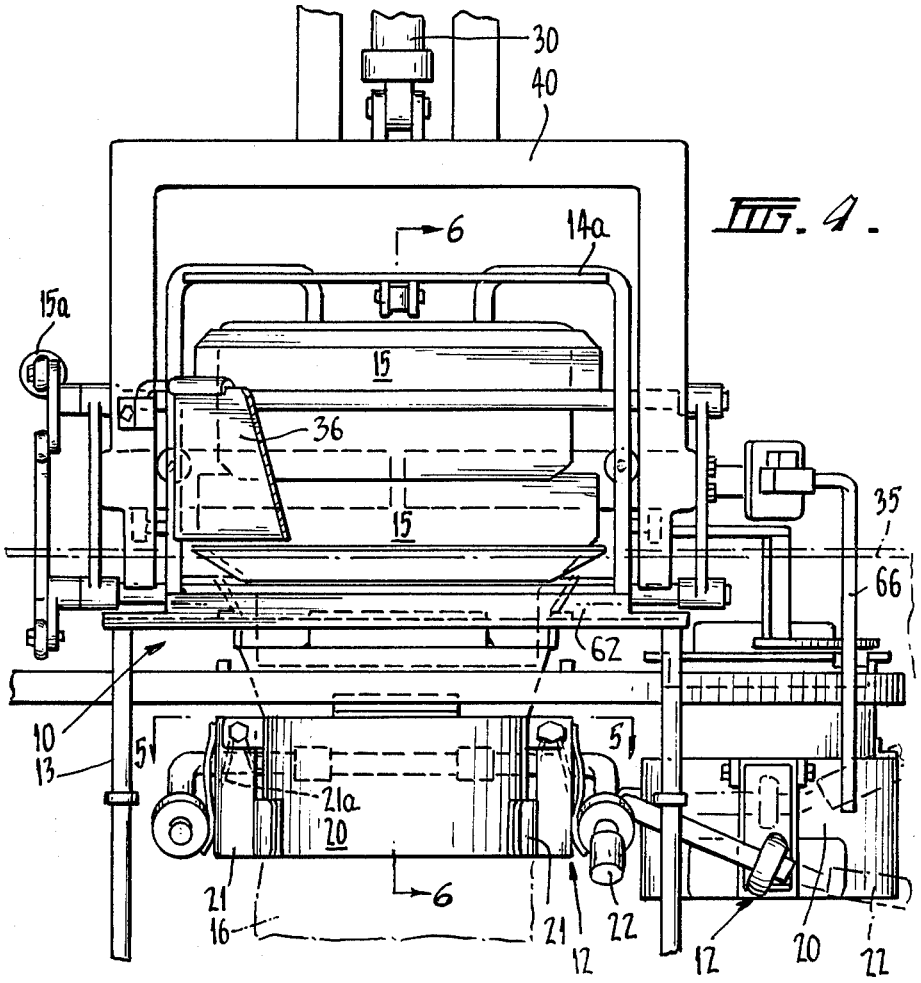
FIG. 4 is a further elevational view of the machine as viewed in the direction of arrows 4—4 on FIG. 1.
Figure 5:
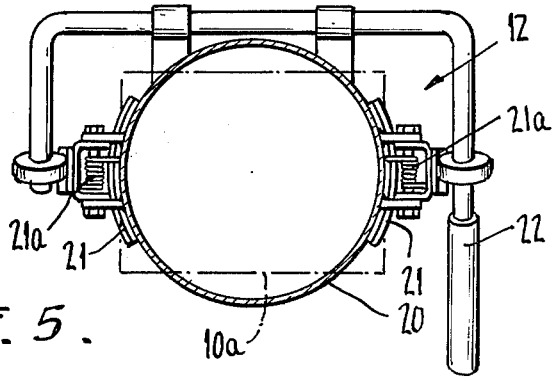
FIG. 5 is a sectional view of a bag clamp and taken on the line 5—5 of FIG. 4.

Having reference to FIGS. 4 and 5, the quick release clamp includes a tubular funnel member 20 having a clamping member 21 pivotally attached thereto. The clamping member is biased by spring 21*a* to move outwardly from the tube member 20 and release a bag or allow positioning of the bag. A U-shaped handle member 22 is also pivotally mounted on the funnel member 20 which engages the clamping member to force it against the side of the funnel member against the spring bias to engage and hold the mouth of the bag to be filled. The clamp funnel structure is positioned beneath each feed hole 10*a* in the indexing table. Thus a bag can be clamped over a feed hole at a position prior to the feeding station and a filled bag can be removed from a feed hole clamp at the next station after the indexing table has been moved a ¼ turn.

Figures 2, 3:
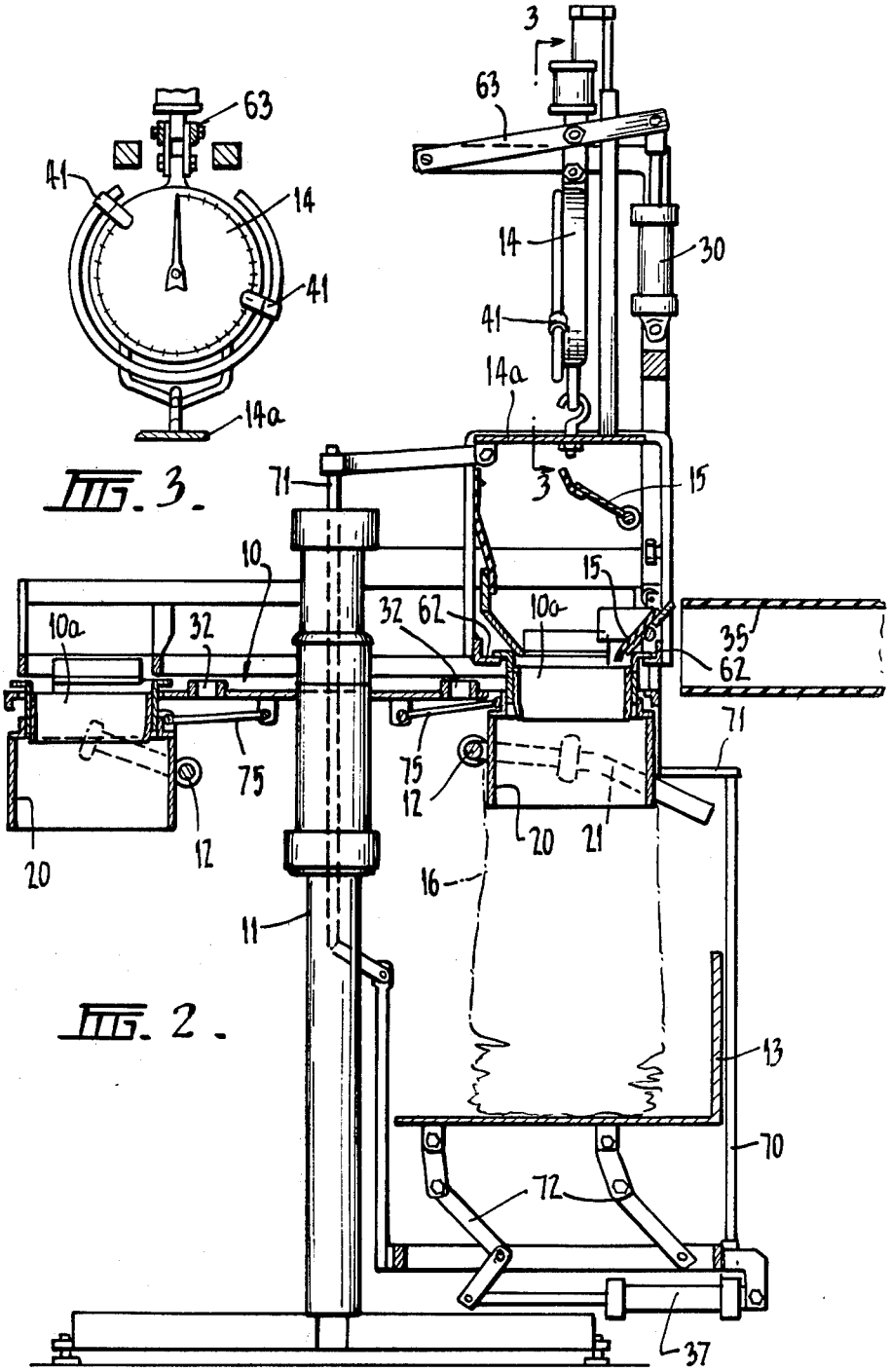
FIG. 2 is a sectional side view of the machine taken on the line 2—2 of FIG. 1.
FIG. 3 is a sectional view taken on the line 3—3 of FIG. 2 and illustrating the weighing device.

Referring to FIGS. 2 and 3, a weighing apparatus 13 is provided at a filling station operative to take the weight of the bag 16 and contents filling into it during a filling operation.

The apparatus includes a scale 14 including a yoke 14*a* engaging with a hook 60 mounted on a feed chute support frame 61. The support frame 61 includes a support ledge 62 interengageable with the upper lip of the feed chute 10*a*. This engagement occurs as the indexing table 10 moves around a quarter turn after each filling operation.

The scale and support frame is mounted on a pivotal linkage 63 connected to a power cylinder 30.

In operation a feed chute 10*a* moves into engagement with the support ledge 62 with a bag already positioned around the opening 20. Platform 13 is supported on platform frame 70 which in turn is supported on linkage 71 extending between the support yoke 14*a* to the frame 70. Platform support linkage 72 supports the platform to move the platform 13 up and down by power cylinder 37. The platform frame is suspended from the support yoke 14*a* through linkage 71. Thus the weight scale 14 takes the entire weight of the support frame 61, the feed chute 20, the bag 16, the support platform 13, platform frame 70 and associated linkage, and power cylinder 37.

In operation, as the indexing table 10 is moved a quarter turn the feed chute 10*a* moves into engagement with the support ledge 62. The feed chute is held steady in a central position by centreing link 75 pivotally connected thereto and the indexing table. Thus the chute is able to slide relative to the indexing table during operation. The floor of the platform support 13 is movable upwardly to engage the bottom of a container to be filled to fully take the weight of the container and to lessen the fall of articles into the container.

The power cylinder 30 is connected to linkage 63 which is adapted to accept the full weight of the weighing platform. Thus the scale 14 measures the weight of contents of the bag container 16 as it is filled. The scale includes a pneumatic switch 41 connected to a control for the various power cylinders 37, 30, 17, 31 and 31*a*. Thus when the scale needle moves around to the switch position representing a full bag container the flow of articles filling into the bag is then stopped; the support platform 13 is lowered and the indexing table 10 moves a quarter turn by power cylinder 17 to engage the next feed chute opening. The full container can thus be removed and sealed.

The article feed device will now be described having reference to FIGS. 1 and 2 and 6. The feed device includes a conveyor belt 35 for articles to be filled into a bag and an oblique plate 36 acting to direct articles lying at random on the conveyor into a single file into the feed chute 20 past blocking flaps 15. The flaps 15 are operatively connected through suitable linkage to power cylinder 15*a* which acts under the control of the sensing switch 41 on the weight scale. It is advantageous that the articles feed past the blocking flaps 15 in single file as this achieves more sensitive and accurate weighing of the articles.

In operation the blocking flaps move to the closed position shown in phantom outline on FIG. 6 to block the flow of articles. The support platform 13 for the bag is then dropped by the power cylinder 37 and the feed chute 20 and full bag moved around a quarter turn for removal from the table.

The platform may move a distance of approximately 6" adjustable and the neck of the bag is concertinaed around the bag clamp 12 so that when the bag is released from the bag clamp there is a slight excess of material to allow convenient closure of the bag by stitching or welding procedures which are well known in the field.

Thus the bagging and weighing machine incorporates a novel bag clamping device, table indexing device, bag weighing and sensing device and an article feed device.

An additional feature of the invention is that the machine will be prevented from operating if a bag has not been clamped or has been incorrectly clamped. Thus referring to FIG. 1, trip arm 66 is provided which will be tripped by clamp arm 22 if the arm is not correctly in its clamping position. Upon the trip arm being activated the power cylinder 17 is locked and ceases to advance the table any further. Also the blocking flaps 15 are locked in closed position to prevent further travel of articles on the conveyor.

I claim:

1. A bag filling and weighing machine comprising a rotary table having at least two spaced apart filling inlets; means for releasably clamping to each of said inlets a bag to be filled with articles at a single filling station; driving means for indexing said table stepwise to present each of said inlets in succession to said filling station; latching means; operating means for releasably latching said table against rotary movement each time said table is indexed to present an inlet to said filling station; weighing means at said filling station for taking the weight of a bag being filled at said filling station; and sensing means associated with said weighing means, said operating means associated with said weighing means, said operating means, and said driving means and operable in response to a bag's being filled to a predetermined weight to effect release of said latching means and indexing of said table.

2. A machine according to claim 1 including conveyor means for delivering articles toward said filling station; means for deflecting articles from said conveyor means toward said filling station and into a bag via the associated inlet when said table is latched; and blocking means for preventing such deflecting of articles during indexing movement of said table.

3. A machine according to claim 1 wherein said driving means comprises a drive pin movable into and out of an opening in said table.

4. A machine according to claim 1 wherein said latch means comprises a latch pin movable into and out of an opening in said table.

5. A machine according to claim 1 wherein said driving means includes a drive pin movable into and out of an opening in said table, and power means for moving said drive pin in an arcuate path when said drive pin is in said opening.

6. A machine according to claim 4 wherein said latch means includes a latch pin movable into and out of an opening in said table, and power means for moving said latch pin into and out of said opening in timed relation to the movement of said drive pin out of and into the opening associated therewith.

7. A bag filling and weighing machine comprising a rotatable indexing table including at least two spaced apart filling inlets adapted to receive a bag to be filled with articles at a single filling station; a clamping device provided on the indexing table for clamping a bag over each filling inlet in an open condition and including a pivotably mounted biased clamp member and a handle engaging said clamp member in a cam-like action operable to close said clamp member against the bias to clamp the bag over the filling inlet and support a bag to be filled with articles fed through the filling inlet; a weighing apparatus at the filling station for taking the weight of a bag being filled; power means for rotating said indexing table in stepwise manner such that each filling inlet and an associated bag on the indexing table successively move to the filling station; sensing means associated with said power means and said weighing apparatus for actuating said power means to rotate said indexing table in response to the filling of a bag to a predetermined weight, the indexing table being adapted to carry an empty bag into a filling position for filling with articles at said single filling station and said filled bag being movable with said indexing table to a position for removal from the indexing table; a conveyor for feeding articles toward and to one side of the filling station; angularly disposed deflecting means mounted above said conveyor for causing said articles to be deflected laterally into said filling station in a narrow path; and a blocking flap for closing said path, said weight sensing device being coupled to said blocking flap to cause actuation of the latter to prevent flow of articles to said filling station during rotation of said indexing table.

* * * * *